US006687112B2

(12) United States Patent
Chiou et al.

(10) Patent No.: US 6,687,112 B2
(45) Date of Patent: Feb. 3, 2004

(54) CONTROL SYSTEM FOR AN ELECTROSTATICALLY-DRIVEN MICROELECTROMECHANICAL DEVICE

(75) Inventors: Jin-Chern Chiou, Hsinchu (TW); Yu-Chen Lin, Kaohsiung (TW)

(73) Assignee: National Chiao Tung University, Hsinchu (TW)

( * ) Notice: Subject to any disclaimer, the term of this patent is extended or adjusted under 35 U.S.C. 154(b) by 35 days.

(21) Appl. No.: 10/101,589

(22) Filed: Mar. 21, 2002

(65) Prior Publication Data

US 2003/0189807 A1 Oct. 9, 2003

(51) Int. Cl.[7] ..... H01H 9/00
(52) U.S. Cl. ..... 361/160; 361/166
(58) Field of Search ..... 361/160, 166, 361/169.1, 170, 277, 290; 271/194, 195

(56) References Cited

U.S. PATENT DOCUMENTS 4,448,346 A * 5/1984 Kuwaki et al. ..... 236/46 R
4,663,538 A * 5/1987 Cotton et al. ..... 307/38
6,039,316 A * 3/2000 Jackson et al. ..... 271/194

* cited by examiner

*Primary Examiner*—Anthony Dinkins
(74) *Attorney, Agent, or Firm*—Bacon & Thomas, PLLC

(57) ABSTRACT

The present invention relates to a control system for an electrostatically-driven microelectromechanical device, which uses multiple electrodes to control the microelectromechanical device, i.e. the lower driven electrode of a capacitor with known two parallel driven electrodes is cut into a number of small electrodes. By selecting an electrode pattern for a desired electrostatic force, it is capable of altering the non-linearity of the device based on various applications and achieving a characteristic such as a linear driven, digital driven, or ultimately optimal driven manners, which is able to reach high operation accuracy for the existing circuit that only possesses a limited accuracy.

10 Claims, 5 Drawing Sheets

| Number of Electrode | Capacitance vs. Applied Voltage |
|---|---|
| 4(400um*100um each) |  |
| 80(40um*50um each) (20 each region) |  |
| 160(20um*50um each) (40 each region) |  |
| 320(20um*25um each) (80 each region) |  |

CONTROL SYSTEM FOR AN ELECTROSTATICALLY-DRIVEN MICROELECTROMECHANICAL DEVICE

CORRELATIVE REFERENCES

The contents of this application has been issued by the inventor. J. C. Chiou et al., on IEEE Optional MEMS 2001, Okinawa, Japan, dated Sep. 27–29, 2001, entitled "A Novel Capacitance Control Design of Tunable Capacitor Using Multiple Electrostatic Driving Electrodes", and also on IEEE—Nano Tech. 2001, Maui, Hawaii, USA, Oct. 28–30, 2001, entitled "A Novel Control Design of Stepping Micromirror Using Multiple Electrostatic Driving Electrodes", all of which are combined into this specification for reference.

BACKGROUND

1. Field of the Invention

The invention relates to a control system for an electrostatically-driven microelectromechanical device; and more particularly, to a system which uses multiple electrodes to control the microelectromechanical device, and selects an electrode pattern and a corresponding driving voltage to drive the microelectromechanical device.

2. Description of the Related Art

In recent decade, the research for constructing MEMS (Micro-Electro-Mechanical System) by integrating microelectronics, microstructures and micro-optical components has been increased dramatically. The key technology in developing the next generation optical MEMS and RF MEMS components relies on the research of the micro-optics, radio-frequency based micro-electro-mechanics. It is noted that MEMS based devices can be applied to various fields which are much attractive to the commercial oriented venture capital. Among others, the essential reason is that by using MEMS technology to design and develop a system is capable of using batch semiconductor manufacturing process to fabricate small sized devices with low cost and high performance, which can comply closely with the trend of environmental protections and economic considerations. Thus it is considered to be the most important technology in developing so called Next Generation Manufacturing Technology.

MEMS has played an important role in developing key technology for optical/wireless communication, and biotechnology using existing or self-developed micro-sensors and/or micro-actuators, for example the MEMS has been widely used for various microwave and millimeter wave applications in the last decade. One of the most important components used in VCO circuits of RF systems is a tunable capacitor, and the MEMS based capacitor can avoid high power losses associated with semiconductors at high frequency. Generally, electrostatically actuating method is thought to be the most common driving method for a MEMS system, since electrostatically driven MEMS system contain advantages of higher operation frequency and lower power consumption. Therefore, in the course of designing a MEMS system, an electrostatic force has been widely used in the fields, such as micro-actuators, micro-sensors, optical components, millimeter wave switches and micro-fluidics.

Conventionally, the electrostatically driven MEMS system always employs two parallel plates with a fixed area and a bias voltage to produce a desired electrostatic force. The more an overlapping area is, the greater an actuating force is generated. However, there is a nonlinear relationship existing between the actuating force and the applied driving voltage (i.e. bias voltage), such that a control design for applications in MEMS system becomes difficult to accomplish, namely, the non-linearity transfer characteristic of electrostatic driving method usually limits the feasibility of the practical realization. Moreover, in order to achieve the accuracy for each of various applications, it needs to employ a sophisticated circuit design with a limited success to comply with a design specification. Nevertheless, this problem prevents us to develop a realistic MEMS system, and it also results in another problem on cost efficiency.

Accordingly, it is necessary to develop a control system so as to improve the existing problem for the nonlinear relationship between the electrostatic force and the corresponding driving voltage, such that possibly obtains the driving characteristics such as a linear driven, a digital driven, and an ultimately optimal driven manners on the MEMS system based on each of the various applications. Thus, it is able to reach a higher operation accuracy for the existing MEMS system which currently only contains a limit accuracy.

SUMMARY OF THE INVENTION

Therefore, in order to overcome the problem described on above, an object of the invention is to provide a control system for an electrostatically-driven microelectromechanical device, which uses multiple electrodes to control the microelectromechanical device, and selects an electrode pattern and a corresponding driving voltage to drive the microelectromechanical device, such that depending on various applications, the control system in accordance with the invention is capable of altering a non-linearity of the device and achieving important characteristics such as a linear driven, a digital driven, and an ultimately optimal driven manners on the MEMS system as well as improving an accuracy of the MEMS system.

For achieving the above object, according to one aspect of the invention, there is provided a control system for an electrostatically-driven microelectromechanical device, comprising: a movable plate, actuated by an electrostatic force, for generating a rotation and a translation actions; multiple electrostatically-driving electrodes, for generating the electrostatic force by applying driving voltages; a switching matrix circuit, having electrical switching components, for switching multiple electrostatic driving electrodes; and a controller, for determinating operation characteristics of the electrostatically-driven microelectromechanical device and selecting electrode patterns through said switching matrix circuit.

Further, according to the above aspect, wherein the above movable plate is a micromechanical suspension element.

Further, according to the above aspect, wherein the multiple electrostatically-driving electrodes are micromechanically fixed plates, and each electrode has a rectangular, a circular and a polygonal shapes as well as has equal of different areas.

Further, according to the above aspect, wherein the electrical switching components of the switching matrix circuit include relays, analog switches, and translator arrays.

Further, according to the above aspect, wherein the controller has a processing unit along with an associate peripheral, and wherein the processing unit is a microprocessor, and the associate peripheral is a memory circuit.

Further, according to the above aspect, wherein the operation characteristics are transfer characteristics of the microelectromechanical device, including physical quantities which are output parameters of the microelectromechanical device and applied DC voltages.

Further, according to the above aspect, wherein the electrode patterns are formed of electrodes which are selected from the multiple electrostatically-driving electrodes in order to form an area for generating the electrostatic force.

Thus, by using the control system in accordance with the invention, the MEMS is possible to have the following efficacies:

1. For different MEMS applications, the control design can be a linear driven, digital driven, and optimal driven manners, etc.;
2. The operation accuracy of the MEMS can be determined by total number of selected multiple electrodes; and
3. The performed of the MEMS can reach a desired accuracy even with a restriction of the limited accuracy of the power supply.

These and other object, features and advantages of the present invention will become apparent from the following detailed description of illustrative embodiments thereof, which is to be read in connection with the accompanying drawings.

BRIEF DESCRIPTION OF ACCOMPANYING DRAWINGS

This disclosure will present in detail the following description of preferred embodiments with reference to the following figures wherein.

PREFERRED EMBODIMENTS OF THE INVENTION

First Embodiment

Figure 1:
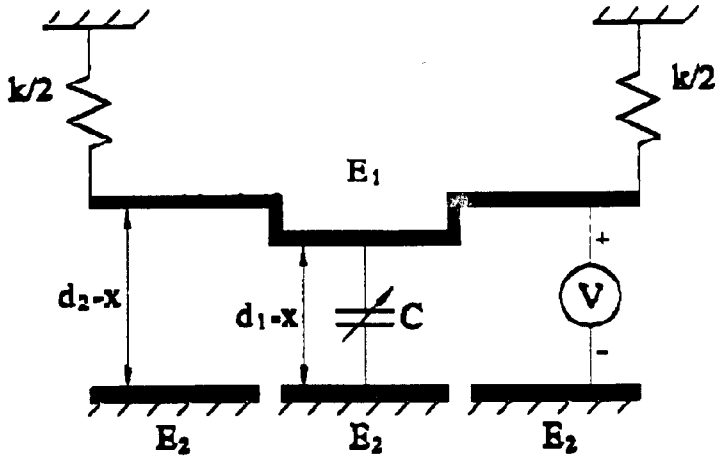
FIG. 1 is a schematic drawing, showing a conceptual electrostatically-actuated tunable capacitor model for improving the tuning range.

FIG. 1 shows a conceptual electrostatically actuated tunable capacitor model for improving the tuning range. The variable capacitance C, which is formed of suspended plate $E_1$ and fixed plate $E_3$, can be tuned by electrostatic force generated by voltage drop between $E_1$ and $E_2$ plates.

Figure 2:
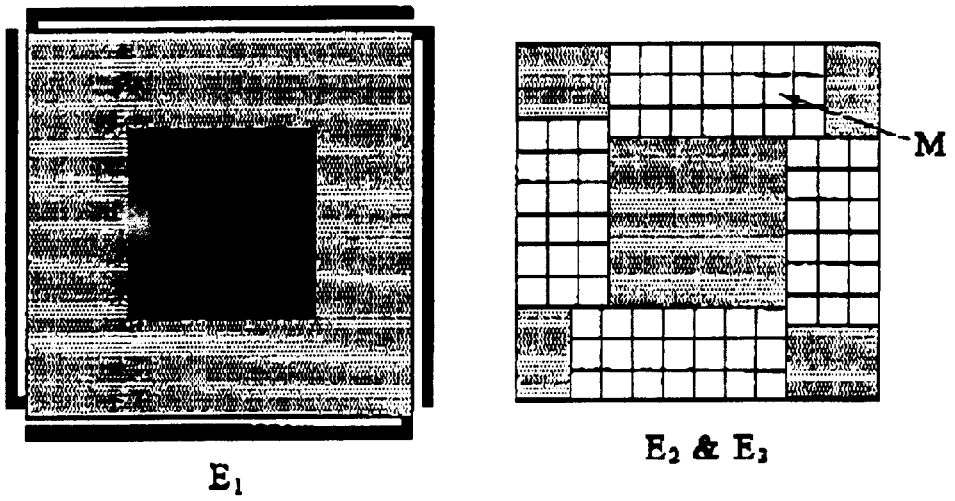
FIG. 2 is a perspective drawing, showing a tunable capacitor with multiple electrodes according to a first embodiment of the invention.

By dividing the original driving electrode on the bottom plate into multiple electrodes that are illustrated in FIG. 2, the system equation given as follows:

$$kx = \sum_j \frac{1}{2}\varepsilon_0 V_{12}^2 \frac{A_{E2j}}{(d_2 - x)^2} \tag{1}$$

$$c = \varepsilon_0 \frac{A_{E3}}{(d_1 - x)} \tag{2}$$

Where k is spring constant, $\epsilon_o$ is permitivity of air, V is applied voltage between electrodes, d is initial gap of electrodes, A is overlap area of electrodes, and x is the displacement of suspended plate $E_1$, and j=0, 1, . . . N. is the number of electrodes $E_{2j}$.

Furthermore, if we consider the areas of the multiple electrodes on $E_2$ are equally divided, then equation (1) becomes $$kx = M\frac{1}{2}\varepsilon_0 V_{12}^2 \frac{A_{E2j}}{(d_2 - x)^2} \tag{3}$$

Where M is the total number of multiple electrodes we can utilize to apply control voltage. By varying the total number of multiple electrodes for the designed capacitor, the working space between the capacitance and applied voltage is varied accordingly. Table 1 lists the transfer characteristics of capacitor from single electrode to multiple electrodes. Clearly, we observe that the relationship between the applied voltage and capacitance is extended from a single nonlinear curve to a series of nonlinear curves. With these characteristics, control designs based on multiple rectangular electrodes that are evenly divided according to the size of upper plate $E_1$ is proposed. By linearly varying the air gap, the corresponding applied voltages and the number of multi-electrodes, M, can be obtained. Thus, by switching the designed electrodes adaptively, the capacitor would generate the desired multiple-stage capacitances.

Here, we define this region as the controllable working-space $R_c$. Within this working space, the transfer characteristic of the capacitor could be designed and fabricated according to desired applications.

Figure 3:
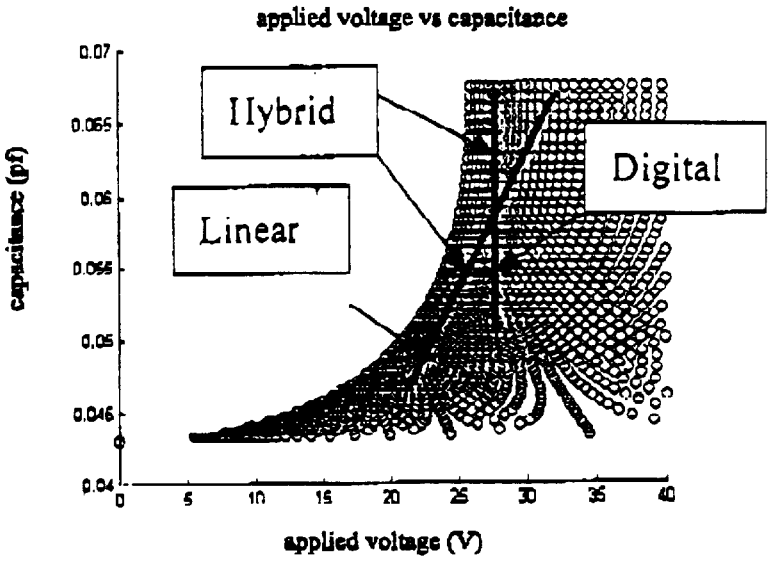
FIG. 3 is a graph, showing a working space and control design curves for the tunable capacitor with multiple electrodes according to the first embodiment of the invention.
Figure 8:
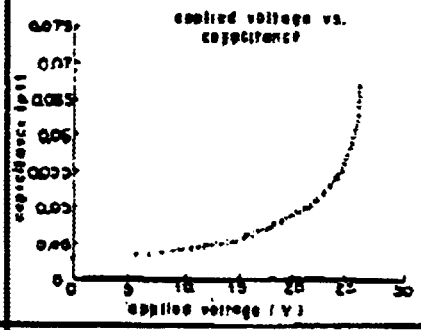
FIG. 8 depicts the characteristics of the capacitor with multiple electrodes.
Figure 8:
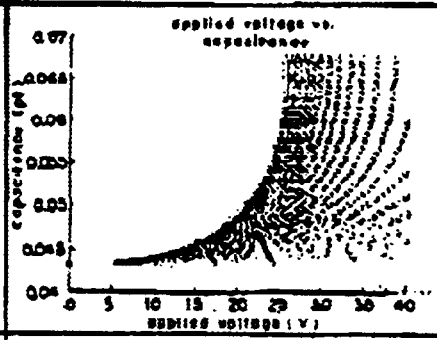
Figure 8:
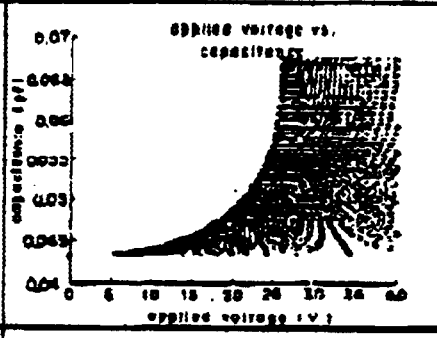
Figure 8:
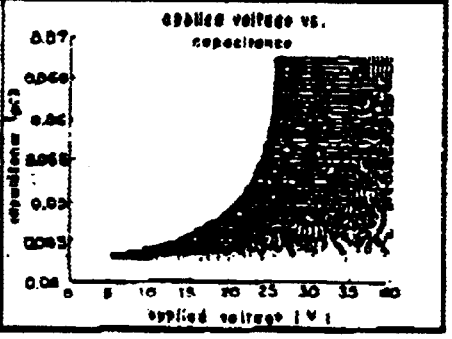

As described previously, the working space $R_c$ determines the solution for the different combination of electrodes and applied voltage. Note that if a specification curve that represents a multi-stage displacement is needed for the design of a specific system, the possible solutions of applied voltage and the combination of multiple rectangular electrodes could be found in $R_c$. By considering the example given in FIG. 8 with 160 electrodes, FIG. 3 shows three control design methods, namely liner-, digital-, and hybrid-design, are proposed to demonstrate the proposed control design.

After transferring the capacitance to displacement characteristics from equation (2), the electrode selection algorithm based on the minimization of error function, E, is applied to search for respective combinations of the number of electrodes that is given by:

$$E = \left| M \frac{1}{2} \varepsilon_0 V_{12}^2 \frac{A_{\varepsilon 2j}}{(d_2 - x)^2} - kx \right| \quad (4)$$

Where M=4, 8, 12 . . . (i.e. number of electrodes). Table 1 lists the search results for three different cases.

TABLE 1

Performance of multiple electrodes

| Desired Capacitance | Designed Voltage | Number of Electrode | Calculated Capacitance | Error |
|---|---|---|---|---|
| 0.051 pF (linear) | 23 V | 144 | 0.05098 pF | 0.039% |
| 0.061 pF (linear) | 28 V | 132 | 0.06025 pF | 1.23% |
| 0.065 pF (digital) | 28 V | 136 | 0.06421 pF | 1.22% |

Table 1 Performance of multiple electrodes

Figure 4:
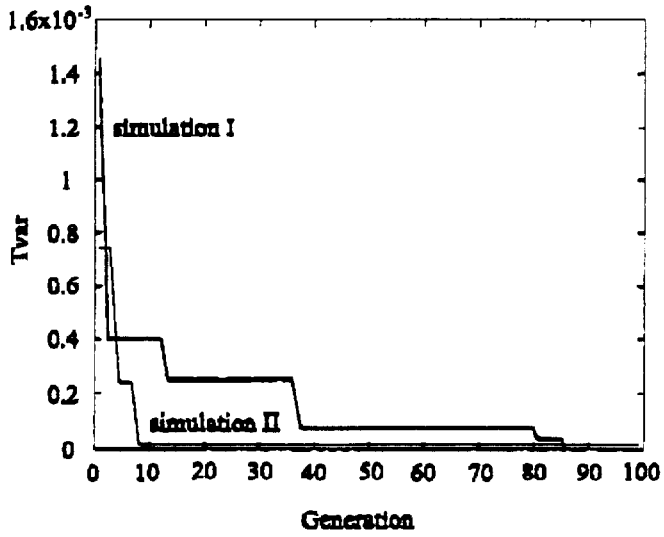
FIG. 4 is a graph, showing simulation results using MGAs for the tunable capacitor with multiple electrodes according to the first embodiment of the invention.

Furthermore, by considering the practical applications such as VCO where the accuracy of the capacitance is the most important issue for the tunable capacitance. An optimal control method based on the Modified Genetic Algorithms (MGAs) is adopted with given fixed capacitance and finite resolution of the supply voltage (e.g. 0.1 voltage for the present study). Table 2 lists the initial parameters of MGAs and FIG. 4 shows two convergent optimal solutions using MGAs.

TABLE 2

Initial parameters for MGAs

| | |
|---|---|
| Bits of chromosome | 16 |
| Number of population | 50 |
| Number of generation | 100 |
| Hybrid GA's operator | Yes |
| Heuristic fitness function | Yes |
| Immigrant operating factor | Yes |
| Self-adjustment parameter | Yes |

TABLE 2-continued

Initial parameters for MGAs

| | |
|---|---|
| Crossover rate | 90% |
| Mutation rate | 3% |

Table 2 Initial parameters for MGAs

In order to demonstrate the accuracy of the proposed control design, a commercial simulation tool for micro-electro-mechanical system design, IntelliSuite™ software, is used to verify the results obtained previously. By constructing the designed electrostatic tunable capacitor system, giving material properties and design parameters (shown in Table 3) and applying calculated voltage from the theory, simulation result of the displacement of the tunable capacitor is obtained. With this result, the capacitance between two parallel plates can be calculated. Table 4 compares the FEM simulations using IntelliSuite™ are derived analytical results for three special cases.

Note that the error percentage of accuracy is below 5% and resolution is reaching 0.002 pf for 160 electrodes case. Finally in order to improve the accuracy and the resolution of the tunable capacitor, we can further divide the electrodes into smaller one. As shown in Table 5, while the number of driving electrodes is increased from 1 to 320, the variance of the accuracy between desired and actual capacitance is decreased from 1% to 0.036%.

TABLE 3

Simulation Parameters

| Material Parameters | Value |
|---|---|
| Young's Modulus | 169 Gpa |
| Poisson ratio | 0.42 |
| Permittivity | $8.854 * 10^{12}$ F/m |
| Beam Width. Thickness | 2 $\mu$m |
| Beam Length | 300 $\mu$m |
| Initial Gap (d1, d2) | 18.5 $\mu$m, 20 $\mu$m |
| $A_{b2}$ | $300 \times 300$ $\mu m^2$ |

Table 3 Simulation Parameters

TABLE 4

Comparisons between designed and IntelliSuite ™ simulation result

| Desired Capacitance | Applied Voltage (designed) | Applied Voltage (calculated) | Number of Electrode | Capacitance FEM Simulation & error (comp. to designed) | Capacitance FEM Simulation & error (comp. to theory) |
|---|---|---|---|---|---|
| 0.063 pF | 29 | 28.7763 | 128 | C = 0.0622 error = 1.27% | C = 0.0608 error = 3.49% |
| 0.059 pF | 28 | 28.1955 | 128 | C = 0.0576 error = 2.37% | C = 0.0583 error = 1.19% |
| 0.065 pF | 30 | 29.8482 | 120 | C = 0.063 error = 3.02% | C = 0.062 error = 4.62% |

Table 4 comparisons between designed and IntelliSuite™ simulation result

TABLE 5

| Performance of the proposed control design (the number of driving electrodes is increase from 1 to 320) | | | | |
|---|---|---|---|---|
| Applied V | | 28 v | | |
| Desired Capacitance | | 0.056 pF | | |
| N | 1 | 80 | 160 | 320 |
| $V_{ideal}$ | | 28.2265 | 28.2265 | 27.99418 |
| M | Depend on applied | 60 | 120 | 244 |
| Capacitance (pF) | Voltage | 0.05544 | 0.05544 | 0.05602 |
| Accuracy | | 1% | 1% | 0.03% |

Table 5 Performance of the proposed control design (the number of driving electrodes is increase from 1 to 320)

A capacitance control design of tunable capacitor using multiple electrostatic driving electrodes according to the invention had been proposed in this specification. Preliminary results have been verified through FEM simulations. With the proposed method, the tunable capacitor device can possesses different characteristics such as linear-, digital-, or hybrid-design. Furthermore, the variance of capacitance can be controlled accurately with specific resolutions.

Second Embodiment

Figure 6:
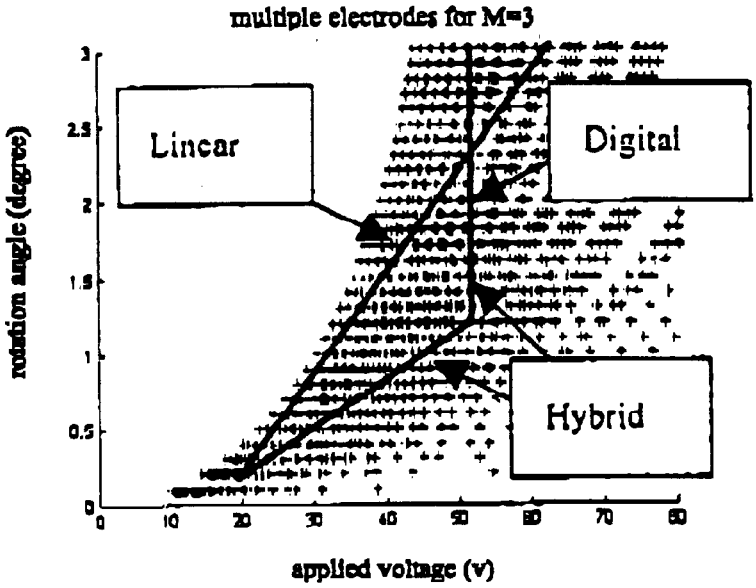
FIG. 6 is a graph, showing a working space and control design curves for the stepping micromirror device with multiple electrodes to the second embodiment of the invention.
Figure 9:
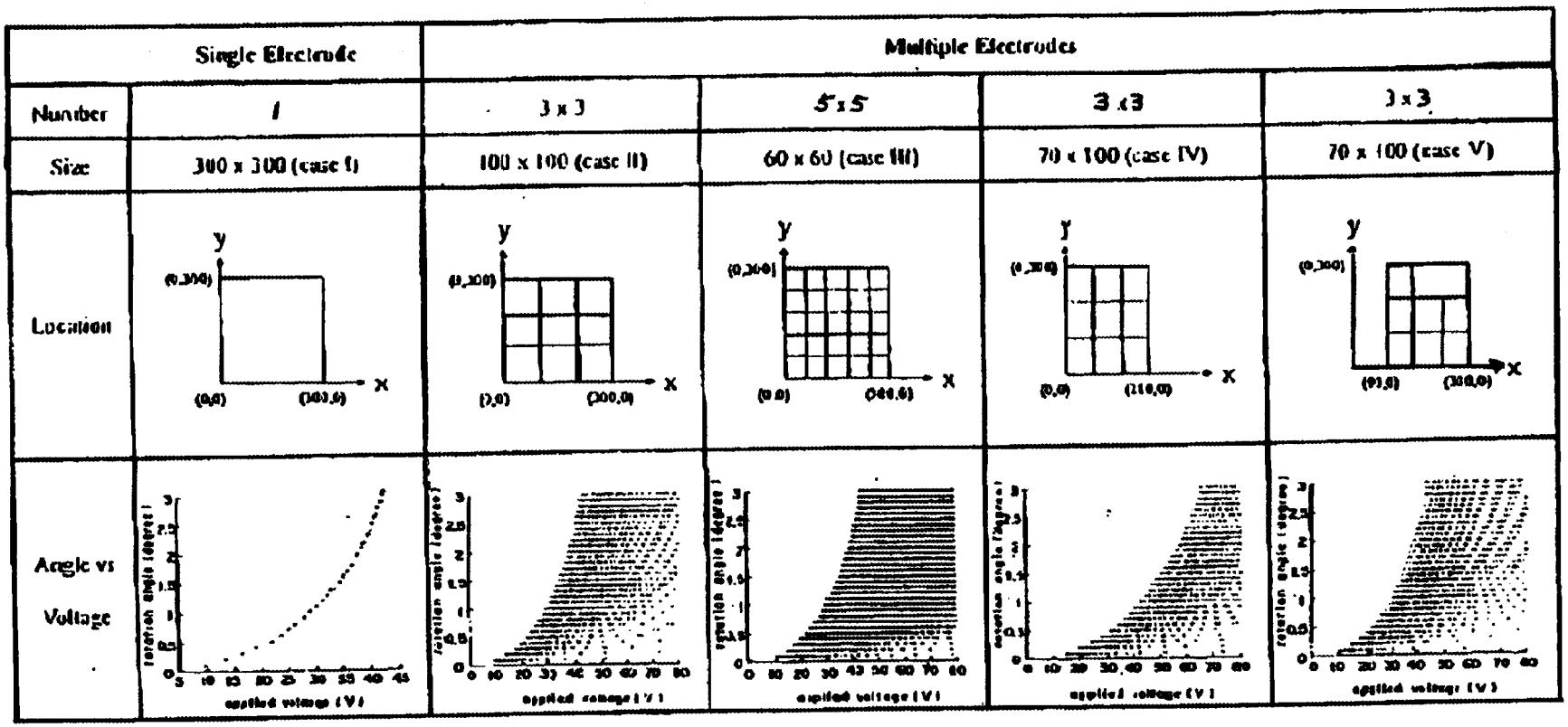
FIG. 9 depicts the characteristics of the micromirrors with multiple electrodes based on analytical results of choosing different number of electrodes and locations.

In the micromirror model of a second embodiment of the invention, we extend the derivation of electrostatic and elastic theory for multiple electrostatic driving electrodes. FIG. 9 depicts the working space of the micromirror that is derived from a single driving electrode to multiple electrodes where nonlinear characteristics have been observed. By using this working-space, the transfer characteristic of the micromirror could be designed depending upon the desired applications. As shown in FIG. 6, three practically realizable control methods, namely the linear-, the digital-, and the hybrid-design, are proposed as demonstration examples here. Through adaptive electrode selection algorithm for control design, the respective combinations of electrodes and locations could be obtained. Table 6 lists the selected patterns for 3×3 electrode case.

Figure 7:
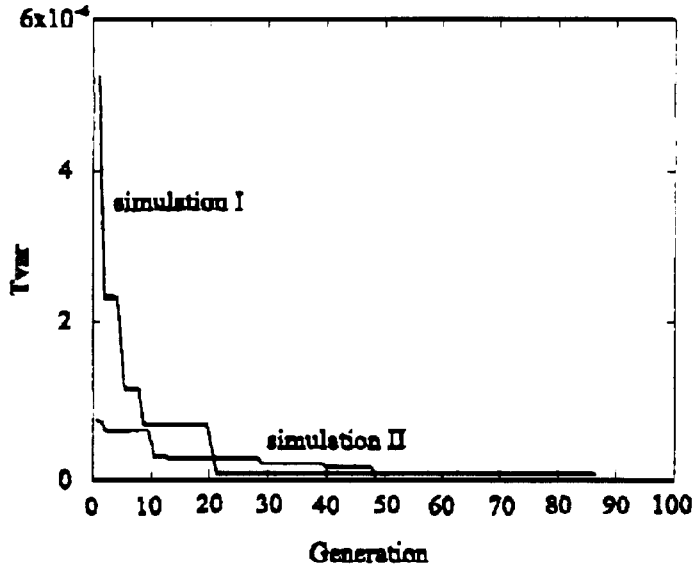
FIG. 7 is a graph, showing simulation results using MGAs for the stepping micromirror device with multiple electrodes according to the second embodiment of the invention.

Furthermore, by considering the practical applications such as optical switching or optical data storage, where the accuracy of the angle is this most important issue for the stepping micromirror device. Here, optimal control method based on the efficient Modified Genetic Algorithms (MGAs) is adopted with given fixed angle and finite resolution of the supply voltage (e.g. 0.5 voltage for the present study). Table 7 lists the initial parameters of MGAs and FIG. 7 shows two convergent optimal solutions using MGAs. Note that the MGAs method could also be used for the solution of adaptive electrode selection algorithm mentioned previously.

Table 8 compares the FEM simulations using IntelliSuite™ to resolutions is reaching 0.2 degree for 3×3 electrodes case. Finally, in order to improve the accuracy and the resolution of the stepping micromirror, we further divide the electrodes into much smaller ones. Table 11 lists the preliminary analysis results where the number of driving electrodes is increase from 1 to 7×7. It has shown that the variance of the accuracy between desired and actual angle is decreased from 5% to 0.0006%.

Figure 5:
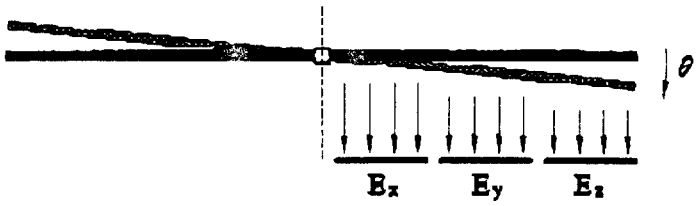
FIG. 5 is a schematic drawing, showing torque from electrostatic force for a second embodiment of the invention, such as for stepping micromirros, which represents not only the number of electrodes but also the locations of the electrodes will determine the final output torque.

In such cases, the workspace is fully populated by increasing the number of electrodes, and the slope of solution's range is increasing when the location of electrodes is moving far away from the original centerline. Note that not only the number of electrodes but also the location of electrodes will determine the range of the workspace $R_c$ for the micromirror devices. This observation can be explained easily in FIG. 5 that had shown not only the number of electrodes but also the locations of electrodes will determine the final output torque. As a result, the number of electrodes dominates the population of solution in the workspace, and the location of electrodes determines the range of solution in the workspace.

In summary, the novel control methods based on multiple driving electrodes for stepping micromirror had been proposed and verified preliminarily from FEM simulations. Through the methods, the micromirror device is capable of generating analog-like behaviors with specific resolutions for practical applications.

TABLE 6

Electrode patterns for 3 × 3 case

| Angle (degree) | Designed Voltage | $W_1W_2W_3$ (Coefficient) | Calculated Voltage | Voltage Error (%) | Electrode Geometry |
|---|---|---|---|---|---|
| 0.3 (Linear) | 20 V | 232 | 19.967 | 0.165 | 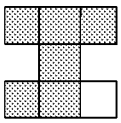 |
| 1.5 (Digital) | 50 V | 221 | 50.177 | 0.353 | 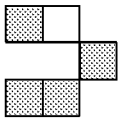 |
| 0.8 (Hybrid) | 42.222 V | 320 | 42.504 | 0.663 | 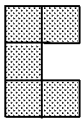 |

Table 6 Electrode patterns for 3×3 case

TABLE 7

| Initial parameters of MGAs | |
|---|---|
| Bits of chromosome | 28 |
| Number of population | 20 |
| Number of generation | 100 |
| Hybrid GA's operator | yes |
| Heuristic fitness function | yes |
| Immigrant operating factor | yes |
| Self-adjustment parameter | yes |
| Crossover rate | 90% |
| Mutation rate | 8% |

Table 7 Initial parameters of MGAs

TABLE 8

The Comparison of the Designed and the IntelliSuite ™ Software Solutions

| Desired Angle (degree) | Applied Voltage (designed) | Applied Voltage (calculated) | ($W_1$, $W_2$, $W_3$) | FEM Simulation Rotation angle & error percentage (designed applied voltage) | FEM Simulation Rotation angle & error percentage (calculated applied voltage) |
|---|---|---|---|---|---|
| 0.9 (optimal) | 61.5 | 61.505 | 101 | θ = 0.926, error = 2.92% | θ = 0.926, error = 2.92% |
| 1.5 (digital) | 50 | 50.177 | 221 | θ = 1.589, error = 5.95% | θ = 1.604, error = 6.90% |
| 3.0 (linear) | 55 | 55.234 | 203 | θ = 2.828, error = 5.73% | θ = 2.904, error = 3.19% |

Table 8 The Comparison of the Designed and the IntelliSuite™ Software Solutions

TABLE 9

| Number of Electrodes | $1^2$ | $2^2$ | $3^2$ | $4^2$ | $5^2$ | $6^2$ | $7^2$ |
|---|---|---|---|---|---|---|---|
| Applied V | | | | 39.4444444444444 | | | |
| Desired Angle | | | | 1.8 degree | | | |
| $W_{ij}$ | 1 | 1, 2 | 2, 2, 3 | 3, 1, 4, 4 | 5, 5, 5, 4, 4 | 6, 5, 0, 6, 6, 6 | 1, 7, 3, 5, 7, 6, 7 |
| Thoery Voltage | — | 38.8215747557 | 39.4035094265 | 39.4640162873 | 39.4404439363 | 39.4438081035 | 39.4444952443 |
| Voltage Error | — | 1.5791% | 0.1038% | 0.0496% | 0.0101% | 0.0016% | 0.0001% |
| Actuated Angle | Depend on | 1.88803 | 1.80552 | 1.79735 | 1.80052 | 1.80089 | 1.79999 |

Table 9 Having described preferred embodiments of the invention (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

| LIST OF REFERENCE NUMERALS | |
|---|---|
| C | variable capacitance |
| E1 | suspended plate (top plate) |
| E2. E3. EX, EY, EZ | fixed plate (bottom plate) |
| RC | working space |

What is claimed is:

1. A control system for an electrostatically-driven microelectromechanical device, comprising:

a movable plate, actuated by an electrostatic force, for generating a rotation and a translating actions;

multiple electrostatically-driving electrodes, for generating said electrostatic force by applying driving voltages;

a switching matrix circuit, having electrical switching components, for switching said multiple electrostatic driving electrodes; and a controller, for determinating operation characteristics of said electrostatically-driven microelectromechanical device and selecting electrode patterns through said switching matrix circuit.

2. The control system according to claim 1, wherein said movable plate is a micromechnical suspension element.

3. The control system according to claim 1, wherein said multiple electrostatic driving electrodes are micromechanically fixed plates.

4. The control system according to claim 3, wherein each electrode of said multiple electrostatically-driving electrodes has a rectangular, circular and polygonal shapes, and has equal or different areas.

5. The control system according to claim 1, wherein said electrical switching components of said switching matrix circuit includes relates, analog switches, and transistor arrays.

6. The control system according to claim 1, wherein said controller has a processing unit along with associate peripheral.

7. The control system according to claim 6, wherein said processing unit is a microprocessor, and said associate peripheral circuit is a memory unit.

8. The control system according to claim 1, wherein said operation characteristics are transfer characteristics of said microelectromechanical device, including physical quantities and applied voltages.

9. The control system according to claim 8, wherein said physical quantities are output parameters of said microelectromechanical device, and said applied voltages are DC voltages.

10. The control system according to claim 1, wherein said electrode patterns are formed of electrodes which are selected from said multiple electrostatically-driving electrodes in order to form an area for generating said electrostatic force.

* * * * *